US007571577B2

(12) United States Patent
Nanayakkara

(10) Patent No.: US 7,571,577 B2
(45) Date of Patent: Aug. 11, 2009

(54) BLAST PROTECTIVE BARRIER SYSTEM

(76) Inventor: Lakdas Nanayakkara, 2065 Park Ct., Boca Raton, FL (US) 33485

( * ) Notice: Subject to any disclaimer, the term of this patent is extended or adjusted under 35 U.S.C. 154(b) by 370 days.

(21) Appl. No.: 11/698,527

(22) Filed: Jan. 26, 2007

(65) Prior Publication Data

US 2007/0193213 A1 Aug. 23, 2007

Related U.S. Application Data

(63) Continuation-in-part of application No. 10/609,170, filed on Jun. 30, 2003, now abandoned.

(51) Int. Cl.
*E04B 1/00* (2006.01)

(52) U.S. Cl. ..... 52/250; 52/251; 52/252; 52/260; 52/319; 14/73.5; 14/74.5; 14/75; 405/272; 405/285

(58) Field of Classification Search ..... 52/250, 52/251, 252, 260, 319, 414, 424, 295, 393; 299/12, 13; 405/272, 273, 284, 285, 286; 14/73.5, 75, 74.5, 78
See application file for complete search history.

(56) References Cited

U.S. PATENT DOCUMENTS

| | | | | | |
|---|---|---|---|---|---|
| 639,961 | A | * | 12/1899 | De Man | 52/396.03 |
| 757,368 | A | * | 4/1904 | Traux | 405/274 |
| 1,356,319 | A | * | 10/1920 | Smulski | 405/286 |
| 1,470,835 | A | * | 10/1923 | Hathaway | 249/176 |
| 1,890,239 | A | * | 12/1932 | Taylor | 52/250 |
| 1,973,427 | A | * | 9/1934 | Brock | 52/295 |
| 2,037,482 | A | * | 4/1936 | Oliver | 52/236.8 |
| 2,595,123 | A | * | 4/1952 | Callan | 52/745.05 |
| 3,348,351 | A | * | 10/1967 | Citarel et al. | 52/393 |
| 4,181,995 | A | * | 1/1980 | Zur | 14/77.1 |
| 4,328,651 | A | * | 5/1982 | Gutierrez | 52/293.1 |
| 4,433,522 | A | * | 2/1984 | Yerushalmi | 52/426 |
| 4,589,341 | A | | 5/1986 | Clark et al. | |
| 4,763,457 | A | | 8/1988 | Caspe | |
| 4,817,963 | A | * | 4/1989 | Munden et al. | 277/316 |
| 5,117,600 | A | | 6/1992 | Yerushalmi | |
| 5,158,399 | A | * | 10/1992 | Flores | 405/285 |
| 5,186,438 | A | * | 2/1993 | Cross et al. | 256/13.1 |
| 5,214,894 | A | | 6/1993 | Glesser-Lott | |
| 5,356,242 | A | * | 10/1994 | Elmore et al. | 405/262 |
| 5,360,296 | A | * | 11/1994 | Angelette | 405/285 |

(Continued)

*Primary Examiner*—Richard E Chilcot, Jr.
*Assistant Examiner*—Matthew J Gitlin
(74) *Attorney, Agent, or Firm*—Melvin K. Silverman; Yi Li

(57) ABSTRACT

A blast protective barrier system, termed a blast wall, providing a security perimeter or boundary at and above a ground level definable in terms of an x, y, z coordinate system, includes several substantially ground level (xy plane) pile caps, each itself having a y-axis elongate length, a x-axis width, and a z-axis depth, the x-axis substantially defining the width of the barrier system. Each pile cap also includes an upper and lower xy plane surface, each of the upper surfaces including y-axis channels and each of the lower surfaces including several recesses. The system also includes a first, second and further modules having a plurality of opposing pairs of yz plane, the y-axis elongate concrete panels including opposing integral xz end cap elements having a high shock-absorptive structure for isolating each module from the effect of a blast upon an adjacent module.

21 Claims, 9 Drawing Sheets

U.S. PATENT DOCUMENTS 5,368,416 A * 11/1994 Cataldo ..... 405/285
5,385,504 A * 1/1995 Hussey et al. ..... 454/169
5,404,685 A * 4/1995 Collins ..... 52/309.7
5,428,926 A * 7/1995 Melfi ..... 52/71
5,588,786 A * 12/1996 House et al. ..... 405/285
5,720,580 A * 2/1998 Ryhsen ..... 405/282
5,741,091 A * 4/1998 St. George et al. ..... 405/283
5,775,038 A * 7/1998 Sauvageot ..... 52/167.8
6,219,982 B1 * 4/2001 Eyring ..... 52/396.04
6,223,473 B1 5/2001 Romig
6,385,930 B1 * 5/2002 Broms et al. ..... 52/251
6,434,900 B1 * 8/2002 Masters ..... 52/283
6,494,004 B1 * 12/2002 Zimmerman ..... 52/251
6,578,333 B1 * 6/2003 Gagliano ..... 52/295
6,681,709 B1 * 1/2004 Nixon et al. ..... 114/241
6,701,564 B2 * 3/2004 Snead ..... 14/77.1
2005/0013668 A1 * 1/2005 Nixon et al. ..... 405/218
2007/0163189 A1 * 7/2007 Venegas ..... 52/222
2007/0193213 A1 * 8/2007 Nanayakkara ..... 52/750
2008/0271652 A1 * 11/2008 White et al. ..... 109/49.5

* cited by examiner

BLAST PROTECTIVE BARRIER SYSTEM

REFERENCE TO RELATED APPLICATION

This application is a continuation-in-part of, and claims the benefit of, application Ser. No. 10/609,170, filed Jun. 30, 2003, entitled Blast Protective Barrier System, the entire content of which is expressly incorporated herein by reference.

BACKGROUND OF THE INVENTION

1. Area of Invention

The invention relates to protective barrier systems.

2. Prior Art

A long-standing concern with respect to terrorist attacks upon so-called soft targets has become that of the now well-known suicide bomb truck which is simply driven into such a target and then detonated. As such, a need has arisen for a barrier system having high blast and penetration resistance which may used in the protection of a wide variety of potential targets including, without limitation, oil tanks, harbors, and buildings of various types. Also, because most of such attacks originate from ground level, it is not necessary that the height of such a barrier system be equal to the height of the target to be protected.

The limited prior art which exists in the present area is reflected in U.S. Pat. No. 4,433,522 (1984) to Yerushalmi, entitled Blast And Fragment-Resistant Protected Wall Structure; U.S. Pat. No. 5,117,600 (1992) also to Yerushalmi, entitled Building Structure Having High Blast and Penetration Resistance; and U.S. Pat. No. 6,223,473 (2001) to Romig, entitled Explosion Relief System Including Explosion Relief Panel. Said reference to Yerushalmi '600 is the most directly known precursor to the instant invention. Therein, a filling material such as loose sand, gravel, pebbles or stones is interposed between opposing concrete panels to form a basic barrier structure. The instant system therefore builds upon the invention of Yerushalmi '600 in its provision of a more economic, modular and flexible system of blast barrier protection.

Other approaches to the problem of blast resistance have appeared in the form of special purpose fillers for placement within walls of structures and, as such, are reflected in U.S. Pat. No. 4,589,341 (1986) to Clark, et al entitled Method For Explosive Blast Control Using Expanded Foam; U.S. Pat. No. 4,763,457 (1988) to Caspe, entitled Shock Attenuating Barrier; and U.S. Pat. No. 5,214,894 (1993) to Glesser-Lott, entitled Wall Construction of a Non-Load Bearing External Wall. The instant invention thereby presents a system in which the void space between opposing panels may, in addition to the use of the loose filling materials taught by Yerushalmi '600, also employ foam-like materials as is taught by Clark as well as cellular units having high viscous damping as is taught by Caspe above. Further, the instant system contemplates use of blast-resistant wall panel modules separated by frangible, blast-expansible, or blast isolation elements so that destruction of one module will communicate a shock wave to adjacent modules.

The prior art does not contemplate such a solution to the need for a blast-resistant security perimeter.

SUMMARY OF THE INVENTION

Taught herein is a blast protective barrier system, sometimes termed a blast wall, which is definable in terms of an x, y, z coordinate system. Said system includes a plurality of substantially ground level (xy plane) pile caps, each itself comprising an x-axis elongate length, a y-axis width, and a z-axis depth, said x-axis length substantially defining the width of the barrier system. Each pile cap also includes an upper and lower xy plane surface, each of said upper surfaces including y-axis channels and each of said lower surfaces including a plurality of recesses. The inventive system also includes a plurality of yz plane, y-axis elongate modules comprising pairs of vertical concrete panels having an x-axis width, each panel pair having a lower y-axis edge proportioned for press-fittable securement within said y-axis channels of said upper xy surfaces of said pile caps. Positioned between opposing pairs of concrete panels is a volume of high shock-absorbent material, which material may take a wide variety of different forms including, without limitation, loose sand, gravel, pebbles, stones, inflatable and non-inflatable foams, enclosed cellular units having properties of high viscous damping, and a variety of acoustical and thermal insulative materials which also possess properties of shock and blast absorption. The system further includes a plurality of elongate piles, each having upper ends thereof proportioned for securement within said recesses of said lower xy plane surfaces of said pile caps, whereby any one of said modular units, if subjected to a blast-related failure of the expansion spacer, thereby isolating the unit from the second or adjoining module, thus preserving the integrity of the rest of the system. Opposing xz plane surfaces of said modules may be secured to each other either through the use of said z-axis vertical elements or spaces, formed of shock-dispersing material, but re-barred to opposing xz surfaces of each module.

It is accordingly an object of the invention to provide a blast protective barrier system which will protect substantially any ground level target from a ground level attack including direct impact by a vehicle loaded with explosive.

It is another object to provide a blast protective barrier system having general utility in a wide variety of security applications and in which modules thereof may suffer destruction without substantial effect on adjacent modules of the system.

The above and yet other objects and advantages of the present invention will become apparent from the hereinafter set forth Brief Description of the Drawings, Detailed Description of the Invention and Claims appended herewith.

DETAILED DESCRIPTION OF THE INVENTION

Figure 1:
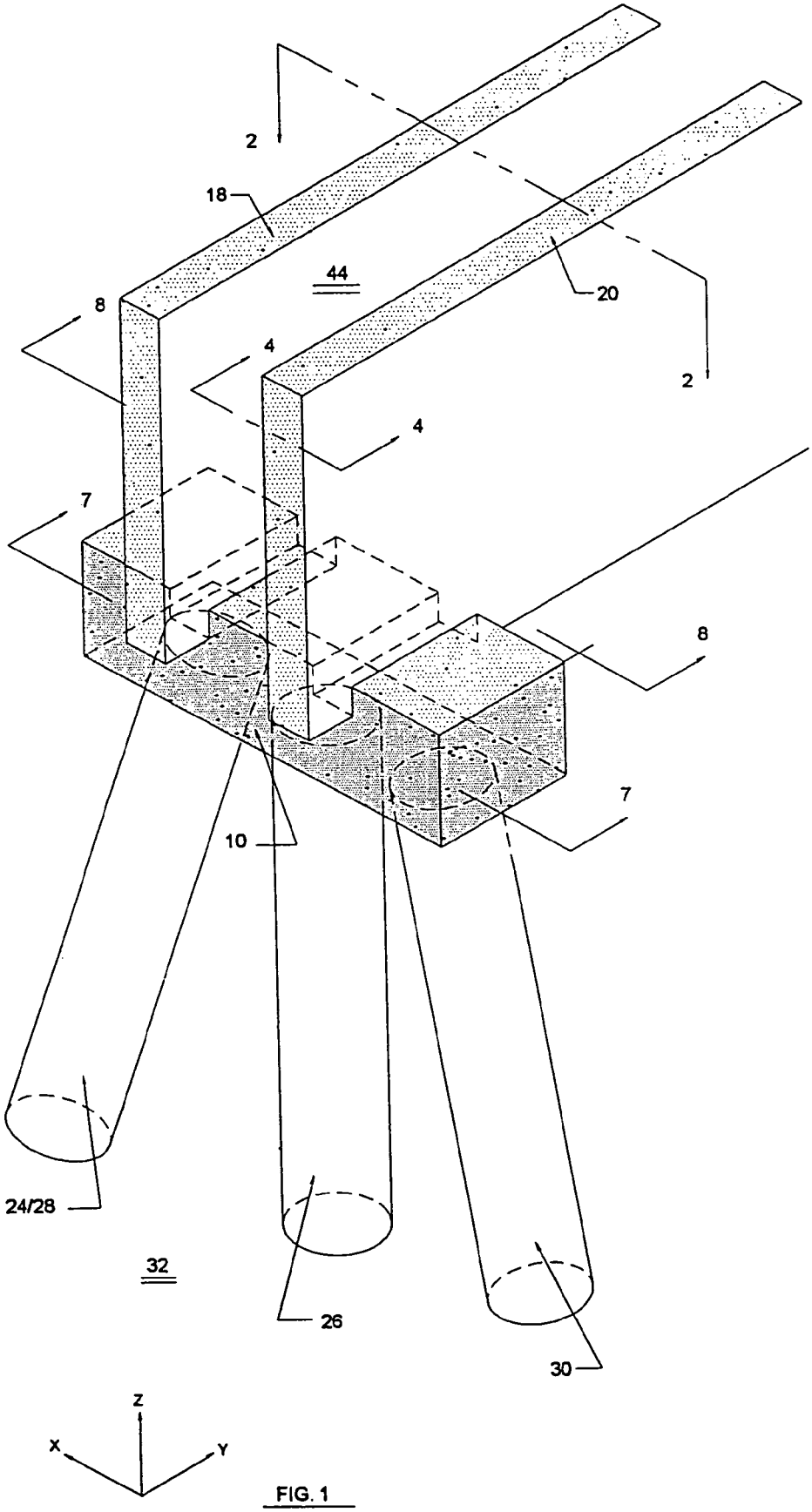
FIG. 1 is a perspective fragmentary end view of the inventive system.
Figure 2:
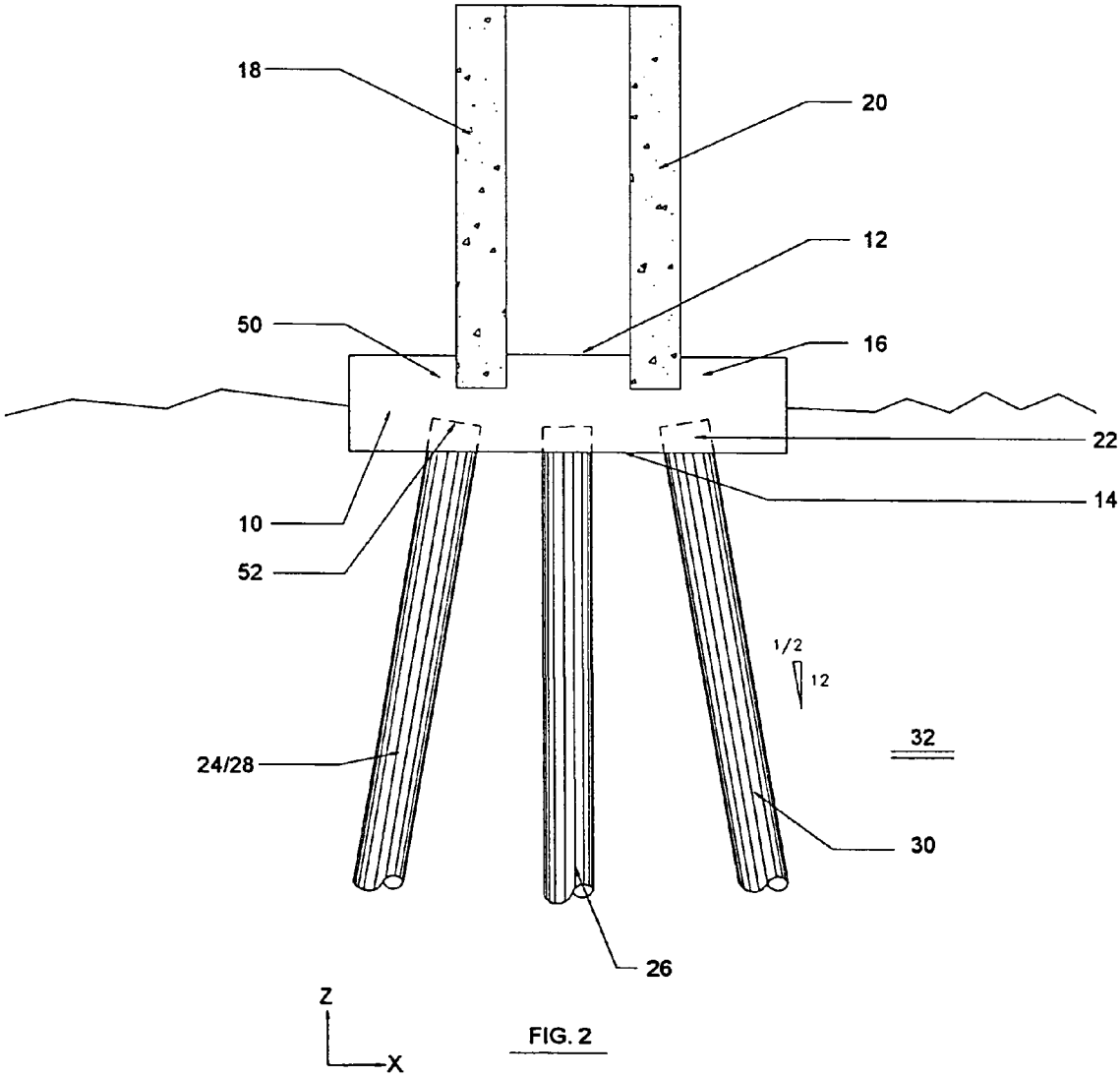
FIG. 2 is a vertical cross-sectional view taken along Line 2-2 of FIG. 1

With reference to the perspective view of FIG. 1, the present inventive blast protective barrier system for providing a security perimeter or boundary at and above a ground level definable with reference to an x, y, z coordinate system (which is shown to the lower right of FIG. 1). Therein, the subject system may be seen to include a plurality of substantially ground level (xy plane) pile caps 10, each comprising a x-axis elongate length (see also FIGS. 2 and 3), a y-axis width and a z-axis height. The length of each pile cap 10 substantially defines the width of the inventive system within the x-axis. As may be particularly noted, each pile cap 10 includes upper and lower xy plane surfaces 12 and 14 respectively. Said upper xy plane surfaces 12 exhibit y-axis channels, or grooves 16 into which concrete panels 18 and 20 (described below) are secured at between 5 and 15% of the height thereof. Within lower xy plane 14 of pile cap 10 are provided a plurality (preferably three) of recesses 22 into which are secured a corresponding plurality of piles 24. In a preferred embodiment, a center pile 26 is aligned with the z-axis or gravity vector, while left and right piles 28 and 30 respectively are offset from the z-axis by an angulation falling in a range of about 15 to about 30 degrees.

Figure 3:
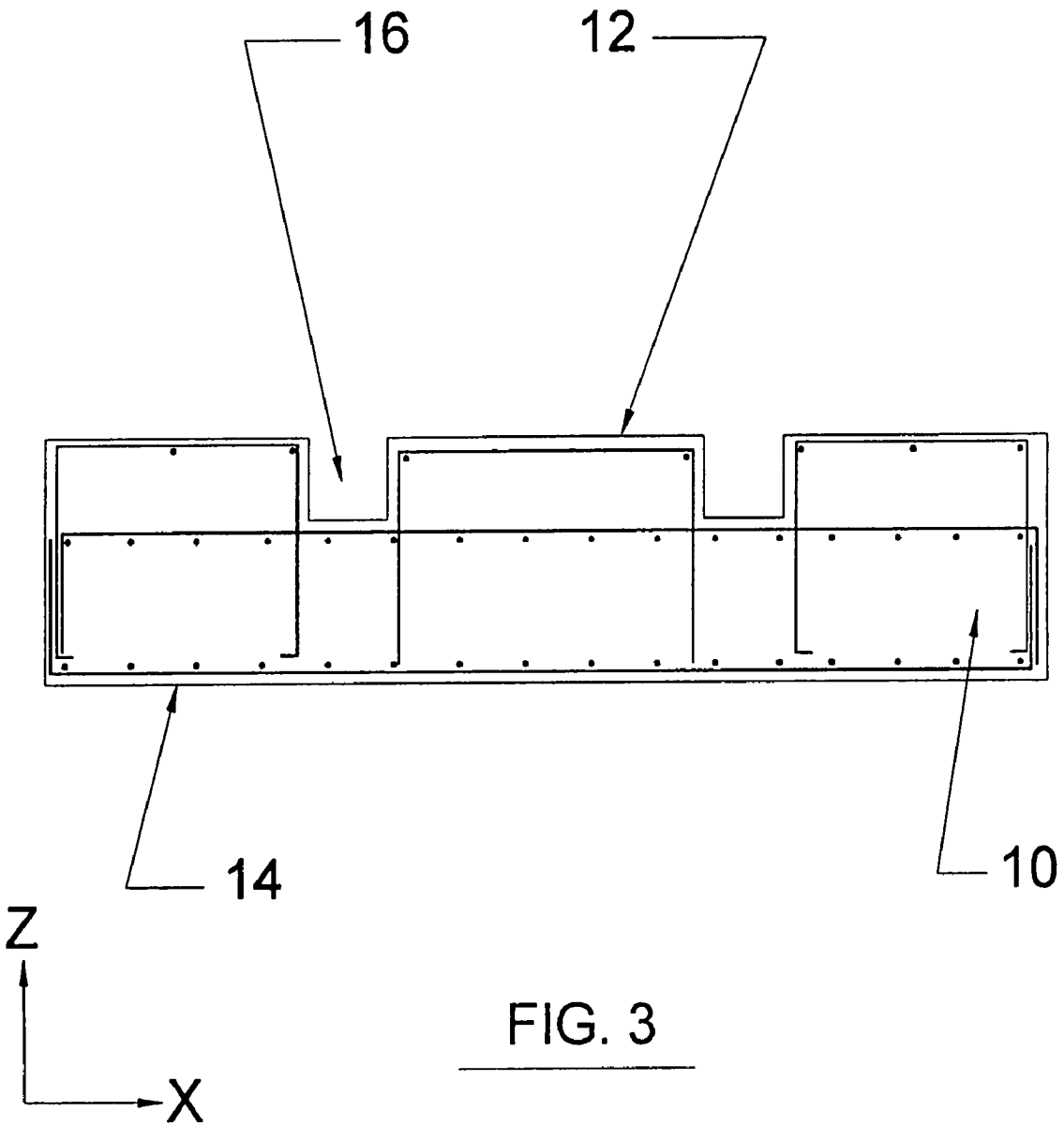
FIG. 3 is an enlarged vertical cross-sectional view of the pile cap shown in FIG. 2.

As may be noted in FIGS. 1 and 3, pile cap 10, after securement to its piles 26, 28 and 30 is constructed as driven or augercast piles, and then back-filled so that earth 32 is then compressed about the piles and pile caps forming a stable foundation for the structure as below described.

Figure 4:
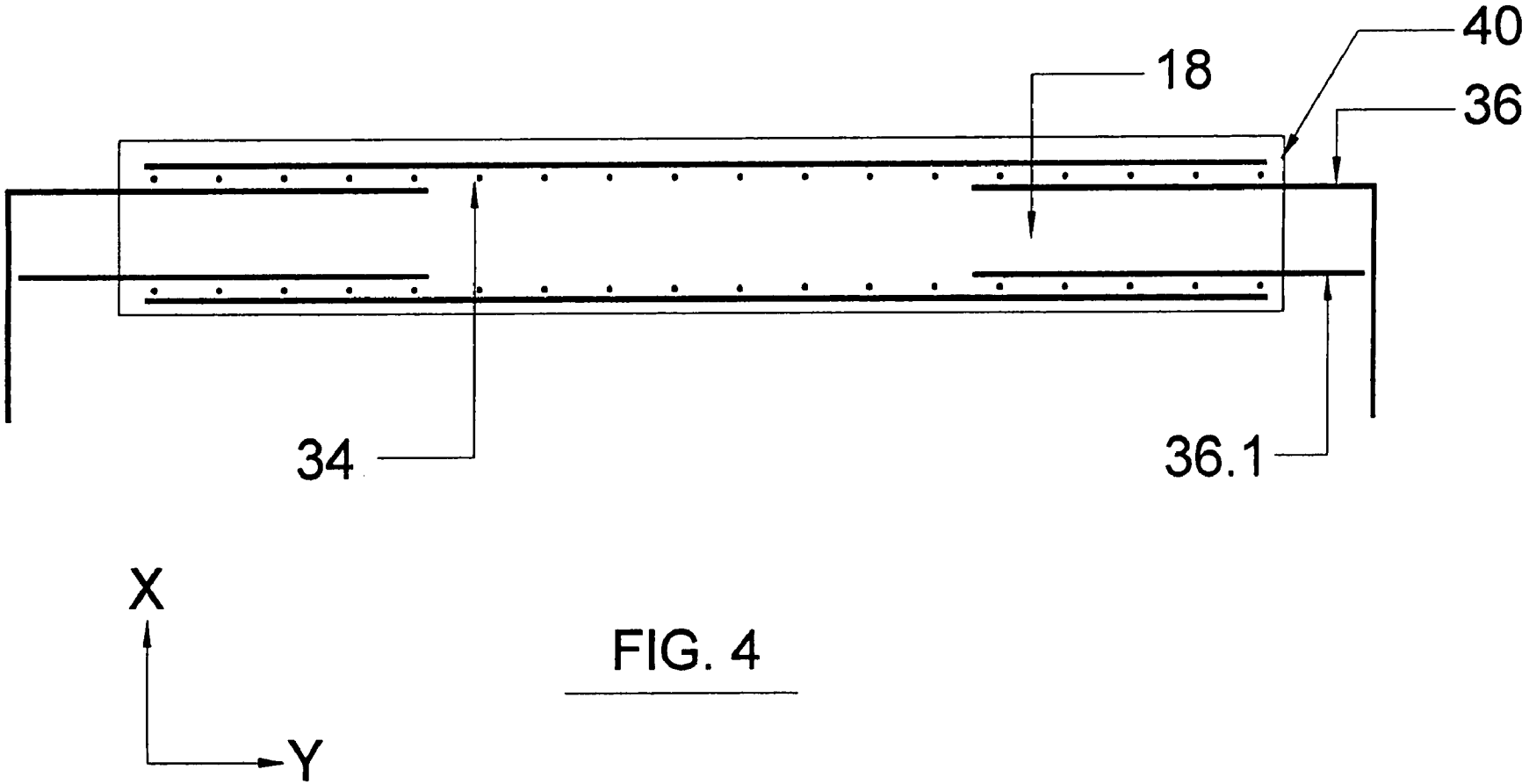
FIG. 4 is a horizontal cross-sectional view of a concrete panel of the system taken in the direction of Line 4-4 of FIG. 1.
Figure 5:
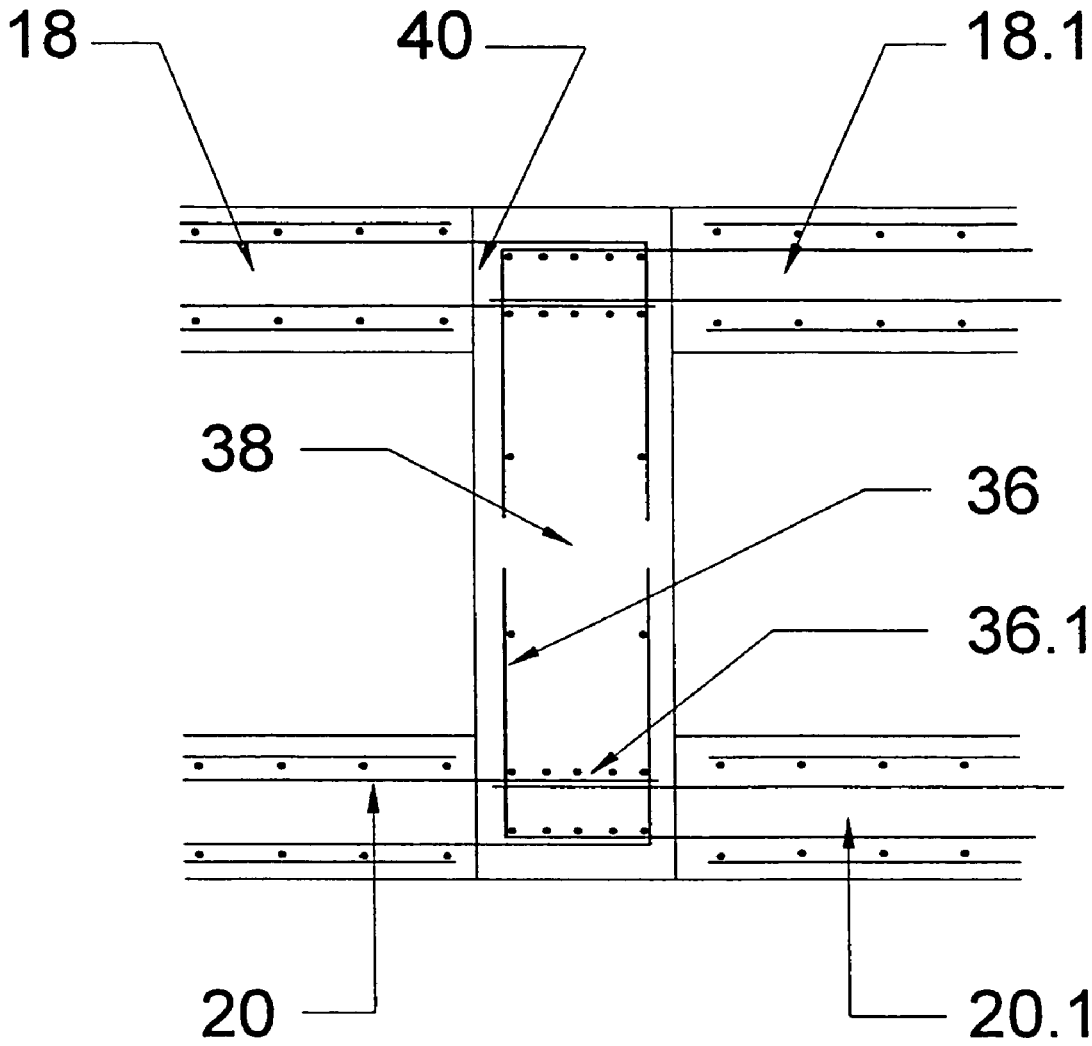
FIG. 5 is a horizontal cross-sectional view showing one method of securement of opposing xz plane end faces of opposing panel pairs of the present system.
Figure 5:
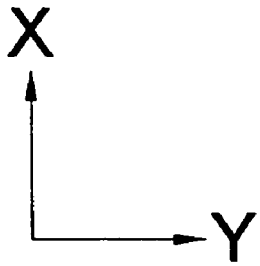
Figure 6:
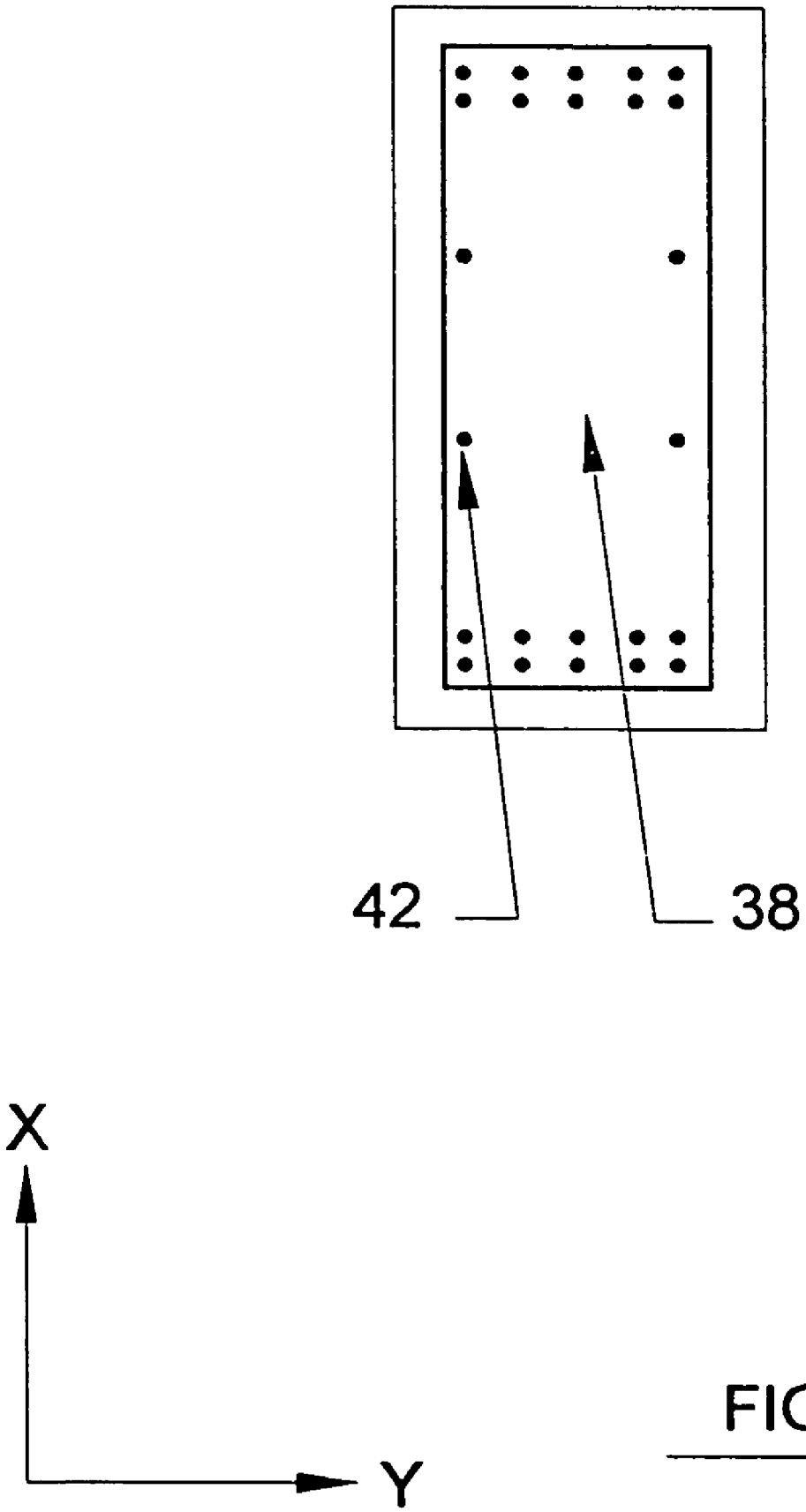
FIG. 6 is a top plan view of the vertical column shown in FIG. 5.

As above noted, the inventive blast protective barrier system includes said yz plane, y-axis panels 18 and 20, each of which defines a module. In another embodiment, a third panel placed medially between said panels 18 and 20. As may, more particularly, be noted in FIG. 4, each panel 18 or 20 is defined by an x-axis width and a y-axis length having a length-to-width ratio of approximately 12 to 1. A preferred x-axis width of panel 18 or 20 is about 12 inches (30 cm). Said panels 18 and 20 are also characterized by the use of vertical rebars 34 and of horizontal, xy plane rebars 36. The function of the vertical rebars is that of reinforcement of the concrete of which panels 18 and 20 are typically formed. The primary function of horizontal rebars 36 is to permit z-axis elongate columns 38 to be poured between opposing xz plane surfaces 40 of panels 18 and 18.1, and 20 and 20.1. Said xz columns 38 are preferably formed of a material having a lesser density than that of panels 18/20, to thus provide a path of least resistance to a blast or shock wave to which the system may be subjected. The purpose of this strategy is to preserve the integrity of wall modules of panels 18/20 not directed subject to attack. A column 38 may take the form of an expansion joint 48 that may comprise a foam-like shock absorbent material, partial void space or any combination that blast-isolates one module from another. Said columns may be positioned and strengthened by the use of re-bars 36.1/42. Said columns 38 are shown in top, xy plane view in FIGS. 5 and 6 as are vertical rebars 36.1/42 within each column 38. To provide for appropriate x-axis offset between opposing ends of panels 18 and 20, each column 38 will typically exhibit a z-axis dimension having a ratio of about 5 to 1 relative to the x-axis dimension of each panel 18/20, thereby allowing a void space in a range of about 45 to about 50 inches (about 125 cm) between each panel 18 and 20. See FIGS. 1, 7 and 8.

Between concrete panels 18 and 20 is provided a volume of high shock-absorbent material such as loose sand, dirt, gravel, pebbles, special-purpose blast suppressing foam barriers, as is taught in U.S. Pat. No. 4,589,341 to Clark, and special shock attenuating cellular elements of the type taught in U.S. Pat. No. 4,763,457 to Caspe, et al.

Figure 7:
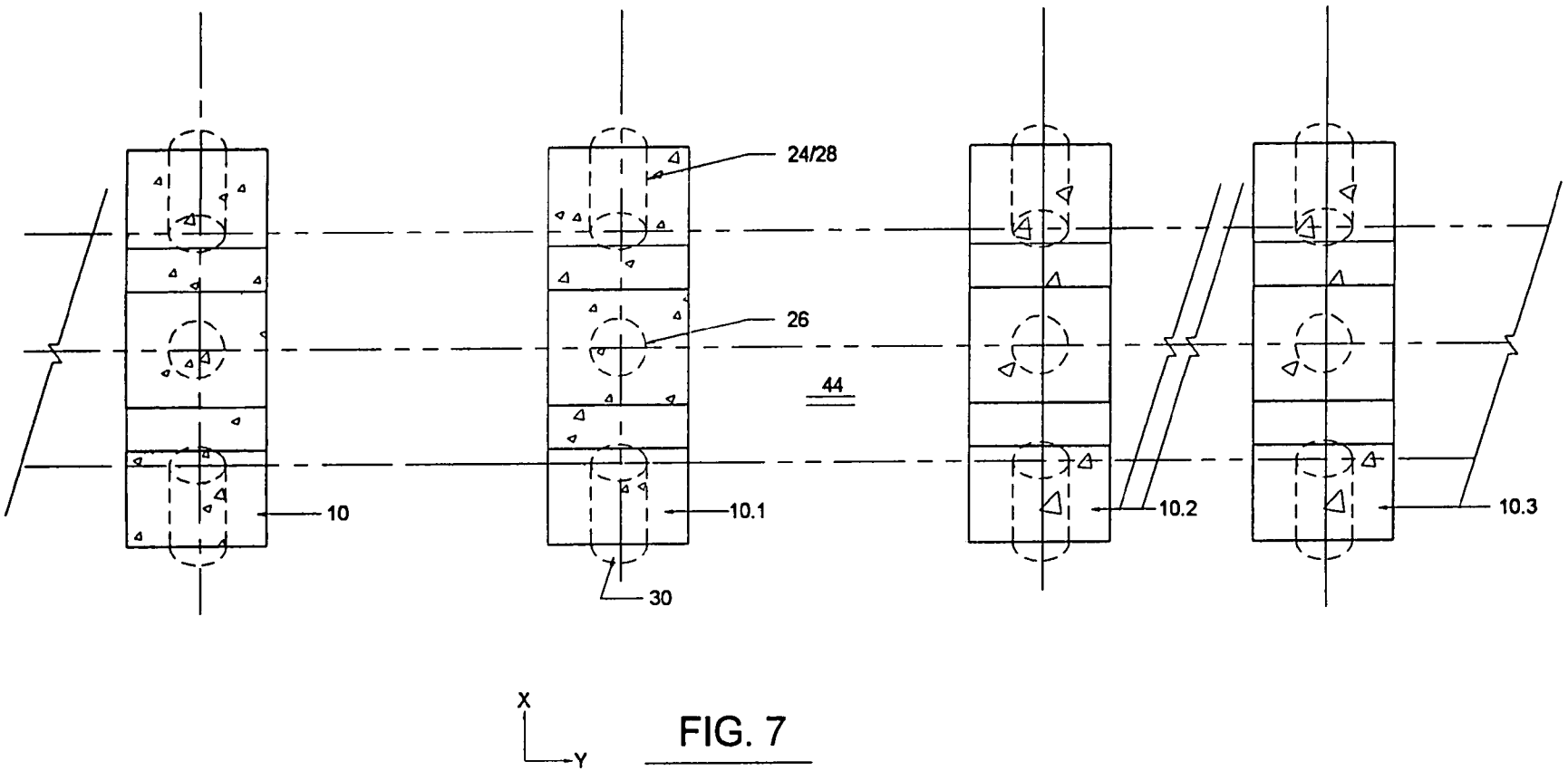
FIG. 7 is a foundation plan of the present system taken along Line 7-7 of FIG. 1 and also showing a typical number of pile caps and associated structures associated with a single unit of the system.

With reference to FIG. 7, there is shown a foundation plan of the inventive system. Therefrom, it may be appreciated that a typical unit of the present blast protective barrier system will consist of pile caps 10, 10.1, 10.2, and 10.3 and their above-described corresponding piles 24 and vertical panels 18 and 20 (see also FIG. 8).

Figures 8, 9:
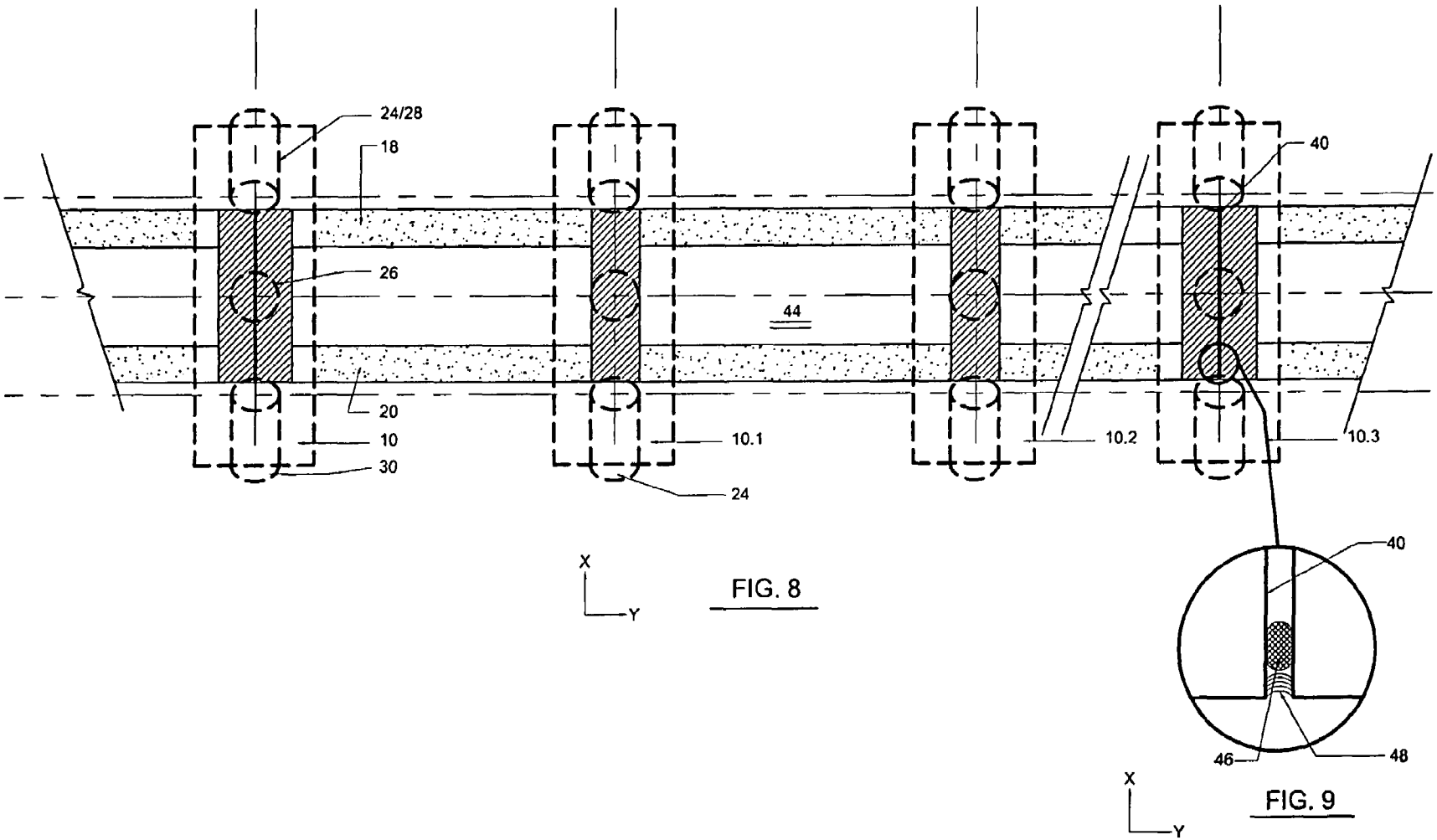
FIG. 8 is a concrete barrier plan of the system taken along Line 8-8 of FIG. 1 and showing the modular character of the units of system.
FIG. 9 is a top schematic view showing opposing xz plane end faces of opposing panel pairs using columns of blast isolation material and expansion and void spaces.
Figure 10:
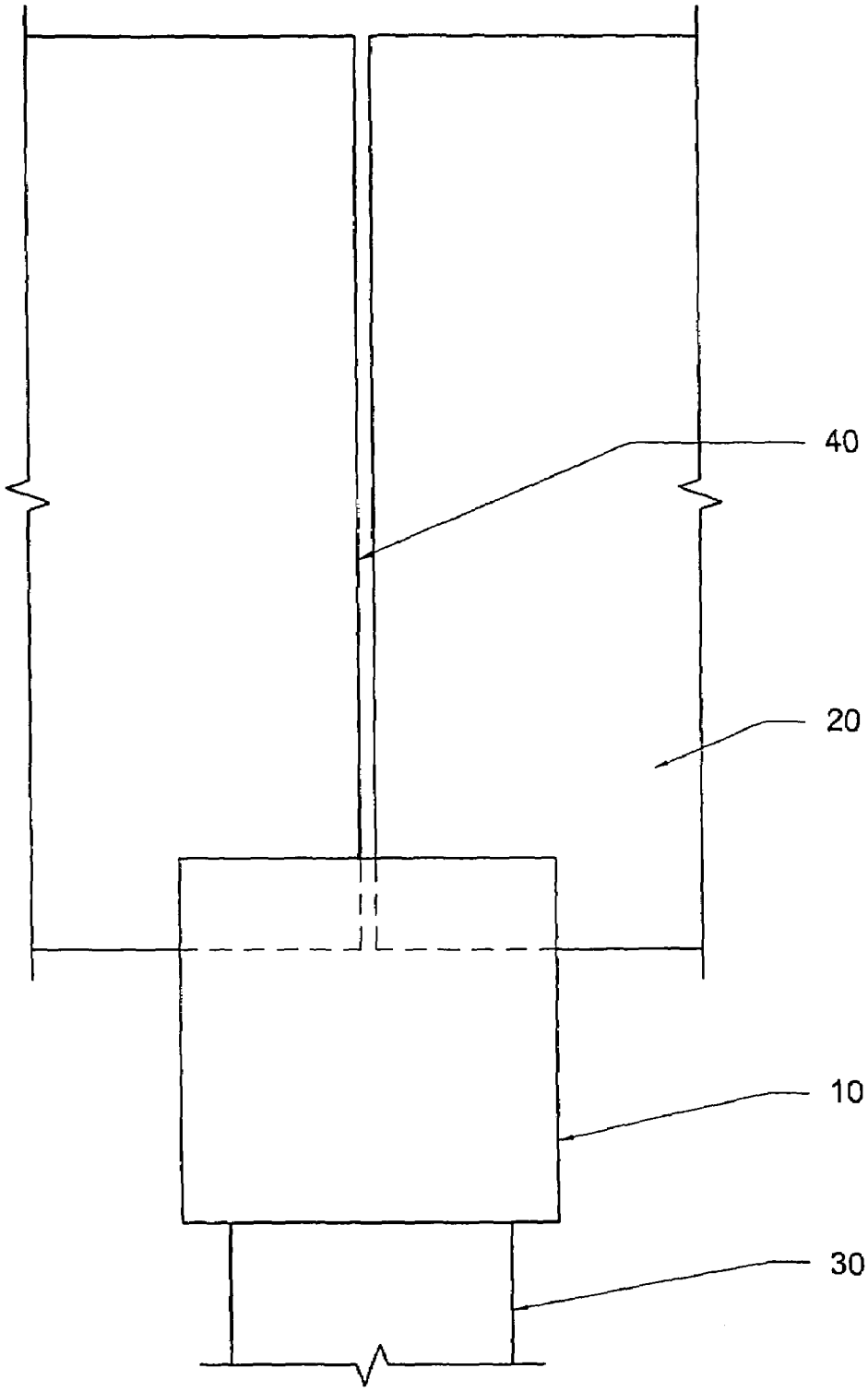
FIG. 10 is a top plan view showing the manner in which the inventive system may be used to protect selected structure.

Expansion joint columns 38 are used for the joinder of opposing xz surfaces 40 (see FIG. 5) of panels 18/20. Rather, special columns 38 include spaces 48 for expansion as shown in FIG. 9. Said spaces assume the modularity of each panel pairs 18/20. Said columns 38 may be furnished with various properties of blast isolation as set forth herewith.

It should be further appreciated that certain other salient dimensional relations exist in the above-described system. Therein, a xz plane of each pile cap 10 in cross-sections of panels 18/20 define a ratio of x-axis pile cap dimension to separation of an opposing panel in a range of about 2.5:1 to about 5:1, in which about 3.5:1 has been found to be preferable. Further, the x-axis length of each pile cap defines a ratio of between about 3:1 and about 1:1 relative to the x-axis width of each panel 18/20. It is further noted that in an xz plane of each panel pair, inclusive of said interposed volume of shock absorbent material, total aggregate x-axis dimension of outer surfaces of said panels to said compacted material comprises an x-axis range of between about 2.5:1 and about 1.5:1. Preferably, and particularly for purposes of ease of production, each modules of panels 18 and 20 will be identical in width and other respects. It is further noted that a x-axis depth of lower ends 5.0 (see FIG. 2) which are within said pile cap channels 16 will comprise a ratio in a range of about 0.05 to about 0.15 of the entire z-axis height of the panels 18/20, in which the ratio 0.07 is preferable.

The depth of piles 24 within earth 32 will typically be within a range of about 10 to about 50 feet in which the separation of the tops 52 of each pile within said recesses of the pile cap may define an aggregate length of about 10 feet. As may be noted in FIG. 6, a ratio of column 38 y-axis length to x-axis width will define a range between about 3.5:1 and 2.2:1. As may be noted in FIGS. 5 and 6, the x-axis width of column 38 will typically slightly exceed the x-axis width of panels 18/20.

It is further noted that the height of each modules of panel 18/20 are typically within a range of about 8 feet (21 cm) to about 15 feet (40 cm), thereby providing sufficient height to protect a terrorist target from the vehicle of considerable height that may be filled with explosives.

It has been also determined that the ratio of z-axis height of each modules of panel 18/20 to the x-axis length of each pile cap 10 may be approximately equal but, more particularly, will reflect a range of about 0.7:1 to about 1.2:1. Thereby, the foundation of the instant structure, in combination with the above-described piles 24 will afford enormous lateral stability to the present structure in the event of an explosive attack or a direct armored assault by a tank, tank artillery or other state of the art ground-to-ground artillery. The structure will of course also provide a defensive perimeter in the event that security personnel are available at the time of such attack.

As above noted (see FIG. 2), the angulation of outer piles 28 and 30 relative to center piles 26 will generally fall within a virtual cylinder defined by the greatest x-axis dimension of pile cap 22. However, where earth 32 is not sufficiently stable or if it is not feasible to dig deeply into the earth, the angulation of the outer piles relative to the center pile 26 may be increased substantially, as may the number of pile provided beneath each pile cap.

The above set forth ratios are deemed material and are deemed the best mode of practice of the invention.

The preferred construction method associated with the above system is:

1. Install piles 24 to the required depth to withstand gravity and lateral loads.

2. Construct pile caps 10 with grooves 16 on each side (full width or partial width) to receive pre-cast concrete wall panels 15 feet (40 cm) to 25 feet (64 cm) long.

3. Make pre-cast concrete panels 18/20 with extended rebars at each end and at bottom of panels with or without the extended rebar.

4. Set pre-cast panel within a groove of the pile cap and lock it in place.

5. Pour concrete connector wall between surfaces of wall panels on top of pile caps at each pile cap location. Use shape of inverted letter "I" to connect to both wall panels and foundation.

6. At every 100 feet (34 meters) to 120 feet (41 meters) provide expansion joint within the wall by construction of shape (double channel back-to-back), with an expansion joint 48 in which material or mechanical means are used to accommodate expansion and contact of individual modules withstand high pressure even if adjacent modules are destroyed.

7. Fill the space between the modules of wall panels 18/20 with loose sand or selected fill material to absorb impact.

8. Connect the top of the wall panels with the concrete slab with cast-in-place or pre-cast concrete panels to act as twin wall on one unit on top of the wall panels.

9. If only single panel wall is to be used, neither backfilling nor top slab is required.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

Having thus described my invention, what I claim as new, useful and non-obvious and, accordingly, secure by Letters Patent of the United States is:

1. A blast protective barrier system for providing a security perimeter or boundary at and above a ground level definable in terms of an x,y,z coordinate system, comprising:

(a) a plurality of substantially ground level (xy plane) pile caps, each comprising a y-axis elongate length, a x-axis width, and a z-axis height, said x-axis substantially defining the width of said system, each pile cap further including upper and lower xy plane surfaces, each of said upper surfaces including y-axis channels and each of said lower surfaces including multiple recesses, said pile caps substantially symmetrical about a yz plane of said lower surface which is at least partially embedded within said ground level;

(b) a first modular unit comprising a plurality of opposing pairs of yz plane, y-axis elongate modules comprising vertical panels having an x-axis width, each panel pair having a lower end disposed within one of said y-axis channels of said upper xy surfaces of at least one of said pile caps, each of said panels beginning and ending in a xz plane end integral with said vertical panels;

(c) at least a second modular unit comprising a plurality of opposing pairs of yz plane, y-axis elongate vertical panels having an x-axis width, each panel pair having a lower end disposed within one of said y-axis channels of said upper xy surfaces of at least one of said pile caps, each of said panels beginning and ending in a xz plane end integral with said vertical panels and opposing an xz plane end of said first modular unit;

(d) expansion elements separating and joining said opposing xz plane end caps of said first and second units;

(e) further modular units comprising further pluralities of opposing pairs of yz plane, y-axis elongate vertical panels having an x-axis width, each panel pair having a lower end disposed within one of said y-axis channels of said upper xy surfaces of said pile caps, each of said panels beginning and ending in a xz plane end cap integral with said vertical panels and an opposing end cap of an adjacent unit;

(f) further expansion elements separating and joining said opposing xz plane end caps of said second and further units;

whereby any one of said modules, if subjected to a blast induced failure, will separate said module from said second or adjoining modules along said expansion spacer, thus preserving integrity of the rest of the system from effects of the blast.

2. The system as recited in claim 1, in which, within an xy plane cross-section of each said pile cap and panel, an x-axis pile cap dimension to that of separation between opposing panel surfaces defines a ratio in a range of about 2.5:1 to about 5:1.

3. The system as recited in claim 2, in which said ratio is about 3.5:1.

4. The system as recited in claim 1, in which, in an xz plane through each panel pair and of a volume of shock absorbent material, a total aggregate x-axis dimension of between inner yz surfaces of said panels to said material comprises an x-axis range of about 1.5:1 to about 2.5:1.

5. The system as recited in claim 4, in which, in an xz plane of each panel pair and said volume of shock absorbent material, a total aggregate x-axis dimension of outer yz surfaces of said panels to said compacted shock absorbent material preferably comprises a ratio of about 2:1.

6. The system as recited in claim 1 in which each panel of said panel pairs are of like x-axis width.

7. The system as recited in claim 6, in which a ratio of said x-axis volume of shock absorbent material to an x-axis dimension of each panel is in a range of about 3:1 to about 2:1.

8. The system as recited in claim 7, in which an x-axis length of said volume of shock absorbent material to an x-axis dimension of each of said panels defines a ratio of about 2.3:1.

9. The system as recited in claim 6, in which a z-axis depth of lower ends of said panels within said y-axis channels of said pile caps to said entire z-axis length thereof comprises a ratio in a range of about 0.05to about 0.15.

10. The system as recited in claim 9, in which a z-axis depth of lower ends of said panels within said channels of said pile caps to said entire z-axis length of each panel defines a ratio of about 0.07.

11. The system as recited in claim 1, in which piles having an upper end secured within said lower recesses of said piles caps define an in-ground length in a range of about 10 to about 50 feet.

12. The system as recited in claim 11, in which each pile cap defines an x-axis length in a range of about 10 to about 20 feet.

13. The system as recited in claim 12, in which each panel is reinforced using vertical and horizontal rebars.

14. The system as recited in claim 13, in which said horizontal rebars project in a xy plane beyond concrete xz end surfaces of said panels.

15. The system as recited in claim 14, further comprising:

a panel joining z-axis elongate columns positioned between opposing xy plane end faces of groups of panel pairs and pile caps, including concrete poured, in a z-axis direction, to envelope said projecting rebars of said respective pairs of said panels, thereby sealing opposing groups of panels at a desired angulation therebetween.

16. The system as recited in claim 15, in which a ratio of column x-axis length to y-axis width comprises a range of between about 3.5:1 and about 2.2:1.

17. The system as recited in claim 6, in which a z-axis height of each panel is in a range of about 8 to about 15 feet.

18. The system as recited in claim 6, in which a ratio of z-axis height of each panel to a x-axis length of each pile cap comprises a range of between about 0.7:1 and about 1.2:1.

19. The system as recited in claim 18, in which a ratio of z-axis height of each panel to an x-axis length of each pile cap is preferably about 0.9:1.

20. The system as recited in claim 1, in which said recesses within said lower surfaces of pile caps comprise three recesses, each defining a different axis relative to a central xz plane of each pile cap, in which:

(a) one of piles having an upper end secured within said lower recesses of said pile caps, one of said piles is co-linear with a z-axis center of said xz plane of symmetry of each pile cap; and (b) substantially z-axis left and right recesses within lower surfaces of said pile cap are equally offset from a central recess and define respective angles in a range of about 10 to about 30 degree relative to said z-axis of said pile cap along said xz plane of symmetry thereof.

21. The system as recited in claim 1 in which each of said expansion elements comprises:

means for isolation of a blast wave impacting one modular unit from affecting an adjacent unit.

* * * * *